US006115970A

United States Patent [19]

Wilczynski

[11] Patent Number: 6,115,970

[45] Date of Patent: Sep. 12, 2000

[54] GUTTER TRAP

[75] Inventor: Daniel V. Wilczynski, 502 E. Perry St., Walbridge, Ohio 43465

[73] Assignee: Daniel V. Wilczynski, Walbridge, Ohio

[21] Appl. No.: 09/248,971

[22] Filed: Feb. 12, 1999

Related U.S. Application Data

[60] Provisional application No. 60/080,822, Apr. 6, 1998.

[51] Int. Cl.[7] ..... E04D 13/00

[52] U.S. Cl. ..... 52/12; 52/11; 52/13; 52/16

[58] Field of Search ..... 52/16, 11, 12, 52/13, 14, 15

[56] References Cited

U.S. PATENT DOCUMENTS

| | | | |
|---|---|---|---|
| 4,171,709 | 10/1979 | Loftin | 137/128 |
| 4,297,053 | 10/1981 | Nicholas | 405/121 |
| 4,386,484 | 6/1983 | Berne et al. | 52/16 |
| 5,114,594 | 5/1992 | Rosebrock et al. | 210/767 |
| 5,452,546 | 9/1995 | Goddard | 52/12 |
| 5,533,303 | 7/1996 | Harvey | 52/16 |
| 5,678,360 | 10/1997 | Fort et al. | 52/14 |
| 5,681,455 | 10/1997 | Takai et al. | 210/154 |
| 5,709,051 | 1/1998 | Mazziotti | 52/12 |
| 5,802,776 | 9/1998 | Murray | 52/12 |
| 5,867,944 | 2/1999 | Attaway | 52/16 |
| 5,867,945 | 2/1999 | Scafidi | 52/16 |

*Primary Examiner*—Christopher T. Kent
*Assistant Examiner*—Jennifer I. Thissell
*Attorney, Agent, or Firm*—Donald R. Fraser

[57] ABSTRACT

A drainage system for a roof gutter and downspout wherein the water and debris from the gutter are directed into a housing divided into two chambers by a perforated wall which permits water to flow therethrough which the debris prevented to travel therethrough.

5 Claims, 1 Drawing Sheet

GUTTER TRAP

This is a continuation of provisional patent application Ser. No. 60/080,822, filed Apr. 6, 1998.

BACKGROUND OF THE INVENTION

1. Field of the Invention

The present invention relates to roof drainage systems and more particularly to a trap device used to trap debris in such drainage systems to prevent debris from clogging gutters and downspouts, for example, which typically are connected to an auxiliary drain line and/or sewer.

2. Description of the Prior Art

There are prior art devices for preventing accumulation of debris in the gutter of a roof drainage system. These devices function to obstruct the entry of debris and permit the flow of drain water.

Some of the systems disclose the use of a removable basket disposed in a section of the associated downspout. During the removal of the basket, some of the collected debris may drop to the associated drain pipes and thereby tends to reduce the overall effectiveness of the system.

SUMMARY OF THE INVENTION

It is an object of the present invention to produce a gutter trap adapted to maintain house and building gutters clean and clear so as to serve the function of collecting rain water and discharging it away from the house or building, and to keep the debris that collects in the gutters from being washed into the storm sewer system.

Another object of the invention is to produce a gutter trap which may be readily attached to any existing downspout and is easily cleaned.

Still another object of the invention is to produce a gutter trap that will collect leaves, twigs, buds, and debris that accumulates in the building and home gutters and store it for disposal while still allowing the gutter system to perform its function.

The above objects of the invention are typically achieved by a drainage system including a roof gutter and a downspout for directing water and debris from the gutter, the improvement comprising:

a hollow housing having an inlet communicating the downspout for receiving water and debris, and an outlet for clean water spaced from the inlet; and a perforated wall dividing the housing into a first chamber and a second chamber, the first chamber being in communication with the inlet of the housing and the second chamber being in communication with the outlet of the housing.

BRIEF DESCRIPTION OF THE DRAWING

The above, as well as other objects and advantages of the invention will become readily apparent to those skilled in the art from reading the following detailed description of a preferred embodiment of the invention when considered in conjunction with the attached drawings, in which.

DETAILED DESCRIPTION OF THE ILLUSTRATED EMBODIMENT

Figure 1:
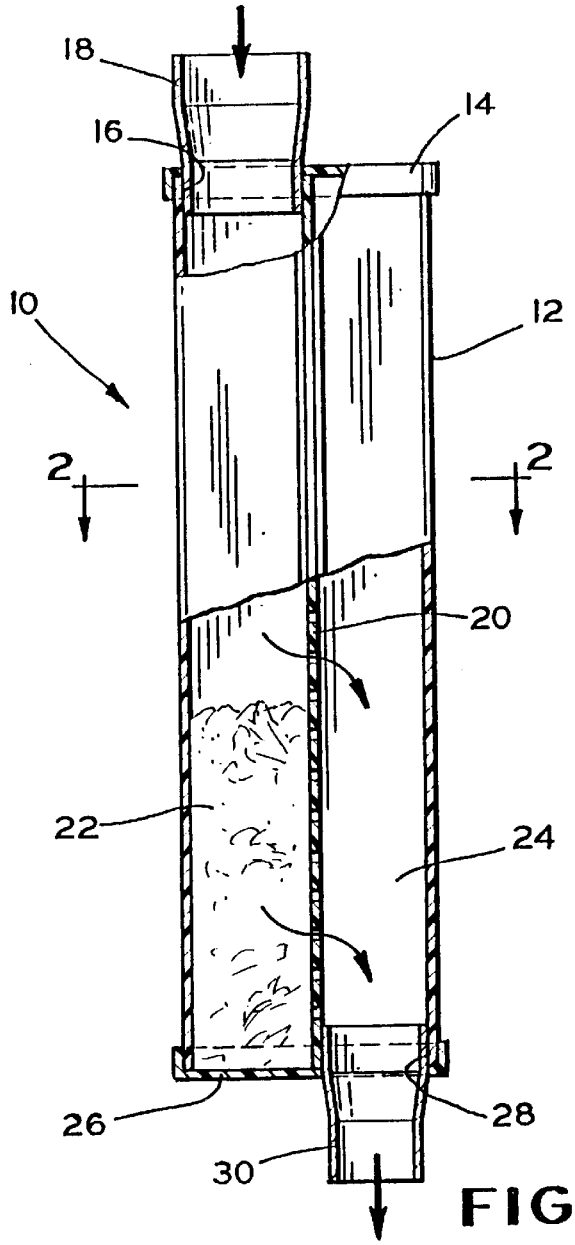
FIG. 1 is an elevational view with portions cutaway of a drainage system in accordance with the present invention.
Figure 2:
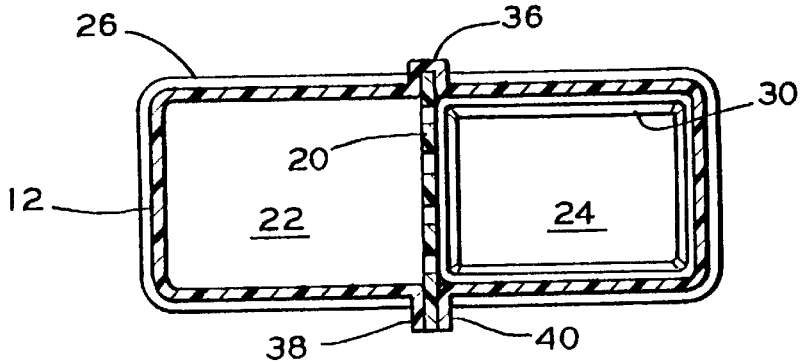
FIG. 2 is a sectional view of the drainage system illustrated in FIG. 1 taken along line 2—2 thereof.

Referring to the drawings, there is shown a drainage system including a gutter trap incorporating the features of the invention. The gutter trap is generally indicated by reference numeral 10 and includes a hollow housing 12 preferably of a rectangular cross section having an up per closed end 14 provided with an opening 16 for communication with a downspout of a roof gutter through a funnel-shaped connection 18, for example. A perforated centrally disposed wall 20 is positioned within the housing 12 dividing the housing 12 into a first chamber 22 and a second chamber 24.

The bottom of the housing 12 is provide d with a bottom wall 26 having an opening 28 formed therein for communication with the sewer, for example, through a reducer-type coupling 30 and an associated downspout.

The housing 12, the upper closed end 14, the lower closed end 24, and the perforated wall 20 may be formed of a number of different materials. These materials included weather-resistance plastic materials such as polypropylene, polystyrene, and other polymers and copolymers; and metals which are either non-ferrous metals or ferrous metals having a non-oxidizing coating.

The housing 12 is typically formed of two sections coupled together by a living hinge 36. The opposite side edges of the sections are provided with outwardly extending cooperating flanges 38 and 40.

The perforated wall 20 may be affixed to the interior of the housing 12 in a number of different manners. As illustrated, one longitudinal edge of the wall 20 is received within the interior longitudinally extending groove formed by the living hinge 36 while the opposite longitudinally extending edge of the wall 20 is snugly engaged by the inner facing surfaces of the flanges 38 and 40. In certain instances it may be found advantageous to provide a clamp to more positionaly cause the flanges 38 and 40 to embrace the one edge of the wall 20.

The first chamber 22 is typically provided with a connection at one end of the connection 18 to the downspout of a roof gutter.

It will be noted that the top of the second chamber 24 is closed, while the bottom wall 26 is provided with the opening 28 for connection with an associated downspout through the reducer coupling 30 which typically communicates with a remote sewer line.

In operation, rain water and debris from a roof gutter, for example, are caused to flow into the first chamber 22 of the main housing 12. The rain water is permitted to flow through the perforated wall 20 into the second chamber 24, while debris is captured and retained in the first chamber 22. The water is caused to pass through the second chamber 24 and is directed to a remote sewer through a connected downspout.

Periodically, the housing 12 is opened, and the perforated wall 20 is removed to allow any debris collected therein to be removed therefrom.

From the above description, it will be obvious that the invention solves the following problems:

Prevents gutters back up and overflow because of a screen device that is sometimes used to prevent debris from entering into the downspout.

Allows the gutters to work more effectively than the use of a screen device that is sometimes used to prevent debris from getting into the gutters in the first place.

Reduces the installation work to install gutter covers or screens.

Avoids the potential of allowing debris to enter into the storm sewer system and leading to other problems or expenses.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A drainage system for a roof gutter and a downspout for directing water and debris from the gutter, the improvement comprising:

a hollow housing having a first end portion having an inlet communicating the downspout for receiving water and debris, and a second end portion having an outlet for clean water spaced from the inlet, said housing including an upper wall and a lower wall; and a perforated wall extending between the upper wall and the lower wall of said housing and dividing said housing into a first chamber and a second chamber, the first chamber being in communication with the inlet of said housing and the second chamber being in communication with the outlet of said housing.

2. The drainage system defined in claim 1 wherein the inlet of said housing is in the upper wall.

3. The drainage system defined in claim 1 including a hinge extending from the first end portion of said housing to the second end portion of said housing and including a coextensive inwardly facing groove.

4. The drainage system defined in claim 3 wherein said perforated wall includes a first edge and a spaced apart second edge, the first edge being received within the inwardly facing groove of said hinge.

5. The drainage system defined in claim 4 wherein the first section and the second section of said housing are mirror images of one another and are provided side edges opposed from said hinge, said side edges being urged toward one another by said hinge to snugly engage the second edge of said perforated wall.

* * * * *